33-241 SR
9/22/87 XR 4,695,159

United States Patent [19]

Cannon

[11] Patent Number: 4,695,159

[45] Date of Patent: Sep. 22, 1987

[54] IMPROVEMENTS IN SIGHTS FOR FIREARMS AND OTHER ARTICLES

[75] Inventor: Albert W. Cannon, Poole, England

[73] Assignee: Focalpoint Armoury Limited, England

[21] Appl. No.: 699,140

[22] Filed: Feb. 7, 1985

[30] Foreign Application Priority Data

Feb. 7, 1984 [GB] United Kingdom ..... 8403242

[51] Int. Cl.[4] ..... G01C 9/02; F41G 1/32

[52] U.S. Cl. ..... 356/247; 33/241

[58] Field of Search ..... 356/251, 252, 247; 33/241, 245, 247, 248; 350/565, 566

[56] References Cited

U.S. PATENT DOCUMENTS

| | | | |
|---|---|---|---|
| 2,336,107 | 12/1943 | Litschert | 33/248 |
| 2,488,541 | 11/1949 | Holme | 33/241 X |
| 2,529,057 | 11/1950 | Teffault | 33/241 |
| 3,696,516 | 10/1972 | Thompson | 33/245 |

FOREIGN PATENT DOCUMENTS

| | | | |
|---|---|---|---|
| 1332512 | 10/1973 | United Kingdom | 356/247 |

*Primary Examiner*—Davis L. Willis

*Assistant Examiner*—S. A. Turner

*Attorney, Agent, or Firm*—Wegner & Bretschneider

[57] ABSTRACT

A sight for a firearm or other article which is intended to be aimed at a target or the like comprises a collimator which is mounted for universal pivotal movement on a mount mounted in turn on an adaptor adapted to mount the sight on a firearm or other article. The collimator contains a light unit located at its front end and arranged to emit a light spot towards the rear of the collimator which has an opening covered by a transparent lens. The light unit is surrounded by a transparent casing which extends in front of the collimator and has a closed end through which extends a jack pin. The pin extends into a chamber in a housing projecting from the mount and provided with adjusting screws for adjusting the angular position of the collimator relative to the mount. A locking screw is provided for locking the collimator in position once a desired adjustment has been achieved.

In use, an observer looks into the sight with one eye while viewing the whole target area with the other eye. The light spot from the sight will appear to the observer to be superimposed on a target and he can use this spot for aiming the firearm or other article at the target.

13 Claims, 5 Drawing Figures

IMPROVEMENTS IN SIGHTS FOR FIREARMS AND OTHER ARTICLES

FIELD OF THE INVENTION

This invention relates to sights suitable for use on firearms, cameras, theodolites and other appliances which require to be aimed accurately at an object. While the invention is primarily concerned with sights for firearms and the following description is mainly concerned with such use, the invention is not restricted to use with firearms.

BACKGROUND OF THE INVENTION

Firearms have conventionally been aimed by placing them manually at a fixed distance from the firer in the line of sight between his eye and an intended target. The traditional method has been to line up a backsight with a foresight and set the combined image against the intended target. A single line of vision towards the target was thus established, providing the sighting was done with one eye. The second eye, being in a different position, observed the two sights as being completely out of line with the target. It was therefore normally kept closed. This gave a restricted field of vision. Moreover, since the eye can only focus on one distance at a time and with open sights there are three planes, i.e. target, foresight and backsight, of necessity two are blurred. An improvement was made with the introduction of an apertured backsight because it was found that the eye will automatically centre itself in the centre of a small round aperture which is in close proximity to the eye, leaving only the foresight and target to be considered. In this case, the eye must focus on the foresight leaving the target blurred giving greater accuracy than if the target is focussed.

To improve accuracy still further, firearms have been provided with telescopic sights whereby a firer can observe an enlarged image of a target through the sight. Aiming was normally achieved by means of cross wires or similar markings on the sight. While considerable accuracy can be achieved with such sights, a disadvantage is that only a limited field of fire can be viewed through the sight. Furthermore, while under poor light conditions a target may be easily distinguished with natural binocular vision, to find the target with a telescopic sight is very difficult if not impossible. The difficulty increases with increased magnification. Thus, while such sights are eminently suitable for stationary easily-identified targets, they are not easy to use with moving or snap targets.

Further, since the eye which is not applied to the sight is usually closed, the firer's vision is even more restricted than when using so-called open sights consisting of a foresight and a backsight on the firearm.

Vision using one eye is unnatural. The human brain is equipped to provide us with binocular vision, whereby the conflicting visual information it receives from two separate sources—our eyes—is computed into a single image. In most people, one eye tends to be more dominant than the other and is often called the "master" eye. It is this eye which we keep open when shooting in the traditional way. Right-handed people normally have a dominant right eye and left-handed people a dominant left eye. With one eye closed, however, our field of vision is markedly reduced and in combat situations this can be a fatal restriction.

It has previously been proposed to overcome the disadvantage of conventional open sights and telescopic sights by providing the sighting device which forms the subject of British Patent Specification No. 1332512. The sighting device according to this prior patent comprised a housing and an outer tube receiving the housing and adapted to be mounted on a firearm. The angular position of the housing in the outer tube was adjustable and the tube had a rearward opening to be looked into by a firer when aiming the firearm. The housing carried a light unit comprising a light collecting member of luminous material having a surface for exposure to ambient light and arranged to emit light in a rearward direction. An aperture in the housing rearward of the light unit provided a circular opening to light emitted from the light unit whereby a luminous spot was visible through the rearward opening of the outer tube. The outer tube was so mounted on the firearm that when the firearm was pointed at a target the luminous spot viewed through the rearward opening in the outer tube coincided with the aiming point of the target.

With such a sighting device, a firer can aim the firearm at a target while keeping both eyes open. One eye will observe the whole field of fire while the other eye, which is applied to the rear end of the sighting device, will see the luminous spot as well as the target area which is not obscured by the sighting device. As a result, the firer's brain will in effect see a luminous spot superimposed on the field of fire. When the spot coincides with a desired aiming point, the firer can fire his weapon secure in the knowledge that his firearm is correctly aimed at the target.

This prior sighting device is easier to use than the previously known sights and does not suffer from their disadvantages. In particular, both eyes are kept open so that the firer has an unrestricted field of view of a target area and can observe and hit moving targets more easily. The device does, however, still suffer from a number of disadvantages. In particular, the provision of an outer tube makes the device cumbersome and adjustment of the housing within the tube is not easy. Further, the light emitted by the light collecting member is visible at night thus making the firer vulnerable to enemy attack.

SUMMARY OF THE INVENTION

The object of the present invention is to provide a sight which overcomes the disadvantages of the prior sighting device and which also provides improvements thereover.

According to the present invention, there is provided a sight which comprises a collimator, a mount, a light unit and an adaptor for mounting the sight on a firearm or other article which is to be aimed at a target or the like, wherein the mount is mounted on said adaptor and wherein the collimator is mounted for universal pivotal movement on the mount, said mount having means for adjusting the angular position of the collimator relative to the mount and means for locking the collimator in any desired adjusted position, the light unit being located at the front end of the collimator and being arranged to emit a light spot towards the rear of the collimator and said rear of the collimator having an opening through which the light spot can be viewed.

In use of the sight according to the invention, an observer looks into the sight with one eye while viewing the whole of a target area with the other eye. The light spot will appear to the observer to be superimposed on the target and he can use this spot for aiming an article on which the sight is mounted at a target.

By directly mounting the collimator on the mount, it is possible to dispense with the need for an outer tube thereby producing a more compact and cheaper construction.

The collimator is desirably mounted on the mount by means of a U-shaped bracket, the collimator being mounted on a pin extending between the arms of the bracket for pivotal movement in a first plane and the web of the bracket being pivotally mounted on the mount for pivotal movement in a second plane perpendicular to said first plane.

Preferably, means are provided to prevent the emission of light from the light unit in front of the sight. This is of importance for military purposes if the sight is to be used on a firearm by armed forces against an enemy at night. Such means may comprise a plate or housing projecting upwards from the mount and located in front of the front end of the collimator According to a preferred embodiment, however, the adjustment means and locking means are incorporated in a housing and engageable with the front end of the collimator or an extension thereof.

The adjustment means desirably comprise a pair of screws the axes of which extend perpendicular to one another. The screws are mounted in screw-threaded bores in the housing and their inner ends are engageable with the sides of a jack pin which is secured, either directly or indirectly, to the front end of the collimator. The locking means desirably comprise a spring-loaded wedge located in a further bore in the housing. One end of the wedge is engageable with the jack pin and the other end is arranged to be engaged by a locking screw mounted in said further bore in the housing, which bore is also screw-threaded for engagement by the locking screw. If the locking screw is screwed out of engagement with the wedge, the adjustment screws can be turned to adjust the angular position of the jack pin, and hence the collimator, relative to the mount, the jack pin being held against the ends of the adjustment screws by the wedge which is acted on by the spring. Once a desired adjustment has been achieved, the locking screw can be screwed in to engage the wedge to hold the jack pin, and hence the collimator, inposition. The wedge should act on the jack pin at an angle of 45° to the axes of both of the adjustment screws. This may be achieved by arranging for the axis of the bore in which the wedge is located to extend at an angle of 45° to the axes of said adjustment screws. Alternatively, the axis of the bore in which the wedge is located may be substantially parallel to the axis of one adjustment screw and substantially perpendicular to the other in which case the end of the wedge which engages the jack pin is inclined to the axis of said further bore at an angle of approximately 45°.

According to one embodiment of the invention, the light unit comprises a light collecting member adapted to collect, amplify and emit ambient light. The light collecting member may be made of a material such as that marketed by Imperial Chemical Industries Limited under the Trade Mark PERSPEX 451 red. This material may be said to function as a light amplifier in that it diffuses light falling onto the outer surface of an element formed from this material and produces visible light from ultraviolet radiation. In this case, the light unit is desirably surrounded by a casing of transparent material which is secured to the front end of the collimator. Preferably, the transparent casing extends between the front end of the collimator and the housing of the mount. The light unit may further include a light-emitting device such as a gaseous tritium light source of the kind sold under the Registered Trade Mark BETA LIGHT.

A shield is desirably provided to limit the emission of light from the light-emitting device of the light unit through the transparent casing at night or under conditions of poor light during the day. This can also be important for military purposes in order not to reveal the position of a firer to enemy forces. The shield preferably takes the form of a tubular sheath or sleeve which is slidably mounted on the collimator. Means may be provided for holding the sheath or sleeve in one or more desired positions on the collimator.

According to an alternative embodiment, the light unit comprises a light-emitting diode located in the collimator at the front end thereof and powered by one or more batteries preferably located in a suitable chamber or chambers provided in the collimator. In this case, it is not necessary to provide a transparent casing nor a shield since ambient light is not used because the brilliance of a light-emitting diode is variable to suit all ambient conditions for maximum clarity without impairing vision.

The rear end of the collimator is desirably closed by a transparent lens which serves to focus the light spot.

BRIEF DESCRIPTION OF THE DRAWINGS

The invention will now be further described, by way of example, with reference to the drawings, in which.

DETAILED DESCRIPTION OF PREFERRED EMBODIMENT

Figure 1:
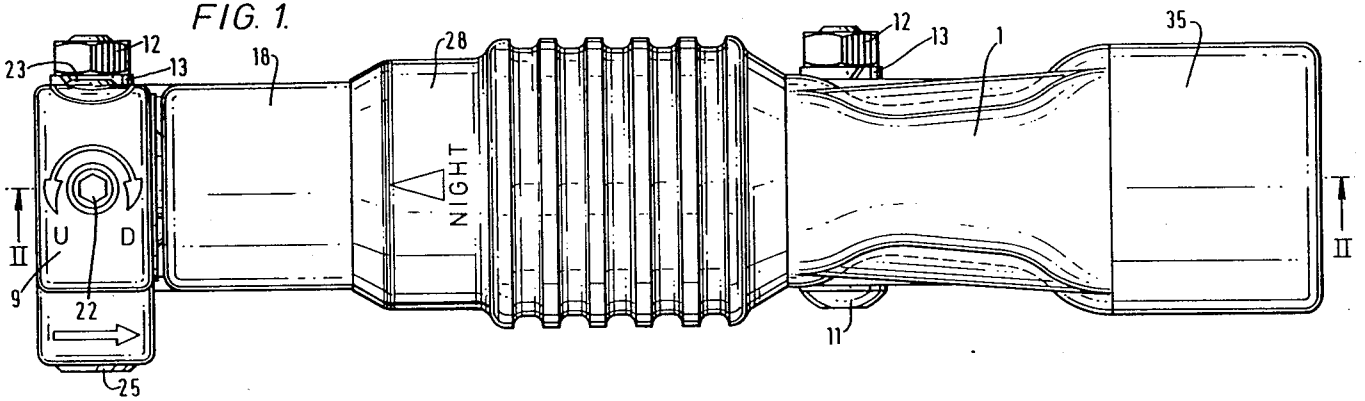
FIG. 1 is a plan view of one embodiment of a sight for a firearm according to the invention.

Referring to the drawings, the sight according to the invention comprises a collimator 1 in the form of a tubular housing which is pivotally mounted intermediate its ends by means of a spring pin 2 in the arms of a U-shaped bracket 3. The web of said bracket 3 is provided with a cylindrical stud 4 projecting away from said web in an opposite direction to the arms and extending through a bore in a plate 7 forming part of a mount 8. A plain washer 5 is fitted over the stud 4 and a locking spring washer 6 is fitted over the end of said stud to secure the bracket 3 to the plate 7. The bracket is, however, free to rotate with respect to the plate.

The main body part of the mount 8 extends substantially parallel to the collimator 1 and terminates, at its front end, in a housing 9 which extends upwardly in front of the front end of the collimator 1. An interchangeable adaptor 10, in the form of a mounting bracket which is adapted to be mounted on a firearm, is secured to the mount 8 by means of a pair of bolts 11 passing through aligned bores in the bracket and mount and secured in place by spring washers 13 and nuts 12.

Figure 2:
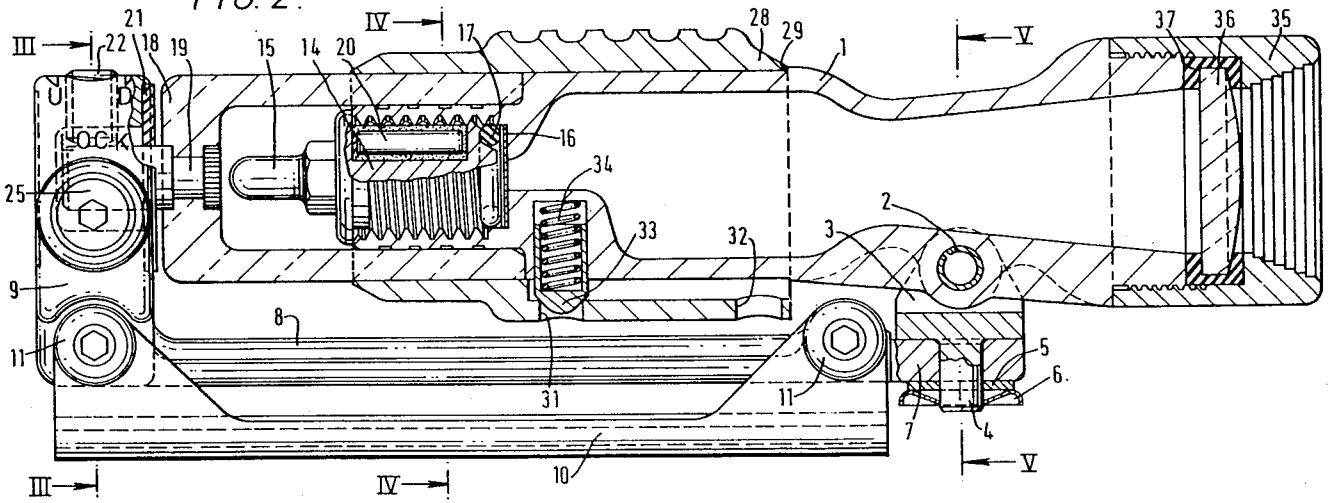
FIG. 2 is a section taken on the line II—II in FIG. 1 in the direction of the arrows.

The front end of the collimator 1 is of reduced diameter and is provided with a screw-threaded bore for the reception of a light unit 14 which is adapted to be screwed into the front end of the collimator with a portion in the form of a light guide 15 projecting from the said front end of the collimator. The light unit 14 is further provided with a slot for the reception of a light-emitting device 20 which consists of a square-sectioned glass tube filled with tritium gas and coated on its inner surfaces with a fluorescent coating and on three of its outer surfaces with a white reflective coating. The remaining face, which is arranged to face the bottom of the slot in the light unit 14 is uncoated so that the maximum amount of light emitted by the light-emitting device 20 is directed into the body of the light unit 14. The light-emitting device 20 is secured in the slot in the light unit 14 by a clear plastics adhesive which is resilient in order to protect the light-emitting device 20 from impact shocks. A screen in the form of an apertured disc 16 is provided in the bore at the inner, rearward, end thereof with an O-ring 17 being disposed between said disc and the light unit 14. The disc ensures that only a small spot of the light emitted by the light unit can pass into the interior of the collimator 1 in the rearwards direction of the sight. A tubular casing 18 of transparent material is fitted over the front reduced diameter end of the housing 1 and is secured in position by adhesive or other suitable means. As can be seen from FIG. 2 of the drawings, the casing surrounds the light guide 15 and is closed at its front end remote from the collimator 1.

A jack pin 19 extends through the closed end of the transparent casing 18 and projects into a chamber in the housing 9. This chamber is closed by a seal 21 of flexible material which surrounds the jack pin but which permits angular movement of said pin relative to the housing 9. The purpose of the seal is to prevent the ingress of dirt and/or moisture into the chamber which could disturb adjustment of the position of the jack pin relative to the housing.

Figure 3:
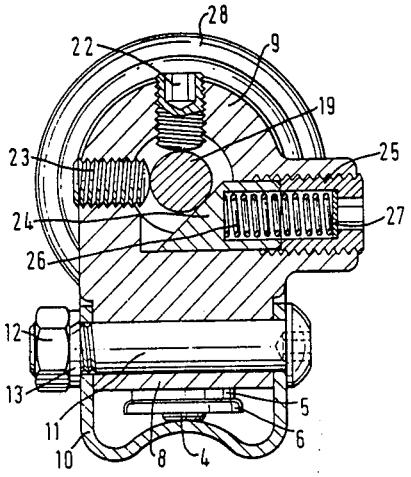
FIG. 3 is a section taken on the line III—III in FIG. 2 in the direction of the arrows.
Figure 4:
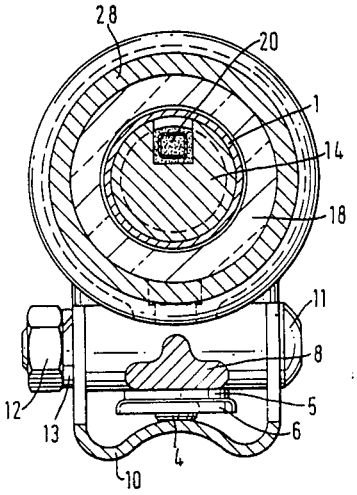
FIG. 4 is a section taken on the line IV—IV in FIG. 2 in the direction of the arrows.
Figure 5:
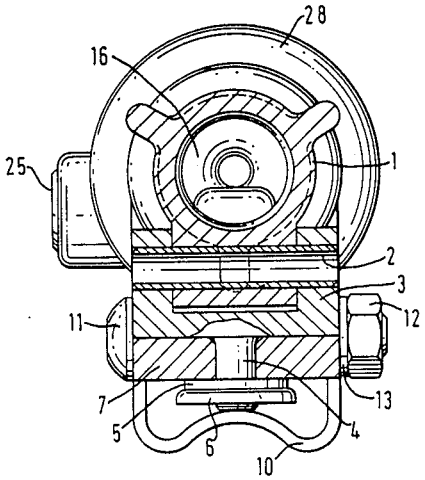
FIG. 5 is a section taken on the line V—V in FIG. 2 in the direction of the arrows.

As shown in FIG. 3 of the drawings, a pair of screw-threaded bores are provided in the housing 9 which bores extend into the chamber and the axes of which are perpendicular to one another. Adjustment screws 22 and 23 are engaged in said bores and project into the chamber. The sides of the jack pin 19 are urged against the inner ends of the screws 22 and 23 by the inclined face of a wedge 24 located in a further bore in the housing 9. This further bore is also screw-threaded for the reception of a locking screw 25 and both the wedge 24 and the screw 25 are partially hollow to receive a coil spring 26. The spring 26 acts on the wedge 24 to force its inclined face against the jack pin 19 which is thus forced against the inner ends of the adjustment screws 22 and 23. A seal 27 is interposed between the end of the spring 26 and the locking screw 25.

FIG. 3 shows the adjustment means of the sight in the locked position. If the angular position of the collimator 1 relative to the mount 8 and adaptor 10 requires adjustment, the locking screw 25 must first be screwed out so that it no longer engages the wedge 24. The angular position of the jack pin 19 in the housing 9 can now be adjusted. The screw 22 serves for adjustment in the vertical plane whereby screwing the screw inwards will depress the jack pin 19 towards the main body part of the mount 8. This will cause the collimator 1 to pivot about the spring pin 2 so that its axis will converge towards the axis of the barrel of the firearm on which the device is mounted. This has the effect of raising the sight. The spring 26 acting on the wedge 24 will be compressed but this will not interfere with the adjustment provided that the locking screw 25 is screwed out sufficiently.

Conversely, if the screw 22 is screwed outwards, the inclined face of the wedge 24, acted on by the spring 26, will cause the jack pin 19 to move upwards away from the main body part of the mount 8. This will again cause the collimator 1 to pivot about the spring pin 2 but this time its axis will be moved to diverge away from the axis of the barrel of the firearm on which the device is mounted. This has the effect of lowering the sight.

In a similar manner, the screw 23 serves for adjustment in the horizontal plane. Screwing the screw 23 inwards will cause the jack pin 19 to move to the right as shown in FIG. 3 although the adjustment will in fact be to the left as viewed from the rear end of the sight. This will cause the U-shaped bracket 3 on which the collimator 1 is mounted to pivot about its stud 4 and thus the sight will be moved to the left. The spring 26 acting on the wedge 24 will again be compressed. On the other hand, if the screw 23 is screwed outwards, the inclined face of the wedge 24, acted on by the spring 26, will cause the jack pin 19 to move to the left as shown in FIG. 3 so that the U-shaped bracket 3 will pivot in the opposite direction and the sight will be moved to the right.

The adjustment screws 22 and 23 are provided with left-hand screw-threads. Thus, for example, turning the screw 22 in anti-clockwise direction as viewed in FIG. 1 will cause the jack pin 19 to be depressed and the sight itself to be raised. It is natural to turn clockwise in the direction the shot needs to be directed and anti-clockwise for retraction. The use of left-hand screw-threads permits this illusion to be maintained. The sight is marked with a double-headed arrow and with the letters U and D for the screw 22 to indicate the direction in which the screw should be turned (U for up and D for down). Similarly, a double-headed arrow and the letters L and R (not shown) are marked on the sight for the screw 23 (L for left and R for right).

It will be seen that the spring 26 acting on the wedge 24, the inclined face of which bears against the jack pin 19, will ensure that the jack pin is held against the screws 22 and 23 at all times during adjustment. Once a desired adjustment has been achieved, the locking screw 25 can again be screwed in to lock the wedge 24, and hence the jack pin 19 and collimator 1, in the desired adjusted position.

Slidably mounted on the main body portion of the collimator 1 is a tubular shield 28 which is adapted to abut, in one end position, against a shoulder 29 formed on the collimator 1. The shield 28 is desirably retained in this, the rearward, position by providing a bore 31 in its side wall in which a plunger 33 is engageable. The plunger 33 is mounted in a bore in a side wall of the collimator 1 and is urged into engagement with the side wall of the shield 28 by a spring 34. The shield 28 can be slid towards the housing 9 and is adapted to be held in its other end position, which is the forward position, by providing a second bore 32 in its side wall in which the plunger 33 is engageable.

The light-emission device 20 emits visible light in all directions and this is undesirable for military purposes at night. The shield 28 can therefore be slid forward in order to restrict the emission of light through the transparent casing 18. In the extreme forward position of the shield 28, the casing 18 is completely covered so that no light can escape. When the shield is in this position, the light unit 14 will receive no light and cannot therefore emit any light. It is under these conditions that the light-emission device 20 comes into use. Such a device is a small nuclear light source which emits a green light. Under normal conditions, this light is suppressed by the brighter light emitted from the light guide 15 so that the light emitted by the device 20 is not noticed. However, when it is dark, light will be emitted only from the device 20.

Since the green light emitted by this device passes into the body of the light unit 14 which is red, the light unit acts as a filter so that the light spot viewed from the rear of the collimator 1 will still appear to be red. If the firer has night vision, he will find that he will be able to see the filtered red light from the light-emission device 20 as a red light spot.

As an alternative, particularly designed for military purposes, the light unit 14 may be replaced by a light-emitting diode powered by batteries (not shown) which can be located in chambers (likewise not shown) in the collimator 1. In this case, the casing 18 may be made of opaque material and the shield 28 can be dispensed with since, as previously explained, ambient light is not used.

The rear end of the collimator 1 is externally screw-threaded and is adapted to receive an eyepiece 35 provided with an internal screw-thread for engagement with the external screw-thread on the collimator. A lens 36 is held in the eyepiece by a lens grommet 37 and is provided to focus a spot of light emitted from the light unit 14 through the disc 16.

In order to eliminate condensation problems within the collimator, the collimator should be filled with an inert gas before the eyepiece is fitted to its rear end. Provided that the eyepiece is not subsequently removed, no condensation problems will arise because of the absence of water vapour within the collimator.

As discussed above, the human brain computes visual information and "in our mind's eye" produces a single picture from disparate images. The sight according to the invention adapts this natural function to the practical requirement of placing a single visual reference point apparently against an intended target. While there is no detectable emanation of light or any other form of energy directed at a target from the sight according to the invention, its operation can suggest this. Just as a powerful search light or laser beam will illuminate a target, so the sight according to the invention appears to be on the target itself. The fact that the light source is internal is not apparent to the user. The sight creates what is in effect an optical illusion. The user's brain "sees" a point of light placed against whatever his weapon will hit if fired. In reality, however, the point of light is contained within the sight and within the user's brain.

The sight according to the invention is fundamentally different from a telescopic sight. A user does not look through the sight but looks past it. The dominant eye sees the light spot from the light unit 14 through the lens 36 but looks past it to concentrate on the target. In the mind's eye, the light spot becomes projected against the target. This is a completely natural, unconscious reaction. With a moving or indistinct target, the user's perception is dramatically increased and the target can be followed with the weapon without consciously aiming at it. The act of aiming is considerably simplified using the sight according to the invention and indeed "aiming" as it has been traditionally understood becomes obsolete.

It will be noted that the sight according to the present invention possesses considerable advantages over the sight described and claimed in British Patent Specification No. 1332512. In particular, the absence of an outer tube makes the sight according to the present invention easier and cheaper to manufacture. Adjustment of the angular position of the collimator is easier and more precise than in the prior sighting device and the shielding of emitted light from in front of the collimator renders the sight according to the invention eminently suitable for military purposes particularly at night.

The invention is not restricted to the above described embodiment but variations and modifications may be made without departing from the scope of the invention. For example, instead of being mounted in the collimator 1, the plunger 33 may, if desired, be mounted in the wall of the shield 28 and be engageable in one or more depressions formed in the side wall of the collimator. In this case, the plunger will be normally urged by a leaf spring against the wall of the collimator. Further, the light-emitting diode may, if desired, be replaced by other light-emitting sources. Moreover, the interchangeable adaptor 10 may take any suitable form, its configuration and construction being largely dictated by the weapon or other article on which the sight is to be mounted.

It should also be noted that the sight according to the present invention is not restricted to use on firearms but can also be used in conjunction with cameras, theodolites and other instruments which need to be aimed at a target or other object.

I claim:

1. A sight comprising a collimator having a front end and a rear end, a mount, a light unit and an adaptor for mounting the sight on a firearm or other article which is to be aimed at a target or the like, said mount being mounted on said adaptor and said collimator being mounted for universal pivotal movement on the mount, said mount having adjusting means for adjusting the angular position of the collimator relative to the mount and locking means for locking the collimator in any desired adjusted position said collimator having means at said front end which are engageable by said adjusting means and said locking means, said light unit being located at the front end of the collimator and being arranged to emit a light spot towards the rear end of the collimator and said rear end of the collimator having an opening through which the light spot can be viewed, wherein a housing projects upwards from a main body part of the mount and is located in front of the front end of the collimator, said adjustment means and locking means being incorporated in the housing and the light unit comprising a light collecting member adapted to collect, amplify and emit ambient light, said light unit being surrounded by a casing of transparent material secured to the front end of the collimator and extending between the front end of the collimator and the housing.

2. A sight as claimed in claim 1, in which said collimator is mounted on said mount by means of a U-shaped bracket, the collimator being mounted on a pin extending between the arms of the bracket for pivotal movement in a first plane and the web of the bracket being pivotally mounted on the mount for pivotal movement in a second plane perpendicular to said first plane.

3. A sight as claimed in claim 1, in which said housing is provided with means to prevent the emission of light from the light unit in front of the sight.

4. A sight as claimed in claim 3, in which the transparent casing has a closed end adjacent the housing and in which said means at the front end of said collimator which are engageable by said adjusting means and said locking means comprise a jack pin which is mounted in said closed end of the transparent casing and extends into a chamber in the housing.

5. A sight as claimed in claim 4, in which said adjustment means comprise a pair of screws the axes of which extend perpendicular to one another, said screws being mounted in screw-threaded bores in the housing and being engageable with the jack pin.

6. A sight as claimed in claim 5, in which said locking means comprise a spring-loaded wedge located in a further bore in the housing, one end of the wedge being engageable with the jack pin and the other end being engageable by a locking screw mounted in the said further bore in the housing, which bore is also screw-threaded for engagement by the locking screw.

7. A sight as claimed in claim 6, in which the axis of said further bore in the housing extends substantially parallel to the axis of one adjustment screw and substantially perpendicular to the axis of the other adjustment screw, the end of the wedge which is engageable with the jack pin being inclined to the axis of said further bore at an angle of aproximately 45°.

8. A sight as claimed in claim 1, in which a tubular shield is provided to limit the emission of light from the light unit through the transparent casing, said shield being slidably mounted on the collimator.

9. A sight as claimed in claim 8, in which means are provided for holding the tubular shield in at least one desired position on the collimator, said holding means comprising a spring-loaded plunger mounted on one of the shield and the collimator and engageable in at least one depression provided in the wall of the other of the collimator and the shield.

10. A sight as claimed in claim 1, in which the light unit includes a light-emitting device.

11. A sight as claimed in claim 10, in which said light emitting device comprises a gaseous tritium light source located in a slot in the light unit.

12. A sight as claimed in claim 1, in which the rear end of the collimator is closed by a transparent lens which serves to focus the light spot.

13. A sight as claimed in claim 12, in which the collimator is filled with an inert gas.

* * * * *